US005613377A

United States Patent [19]

Marchesi et al.

[11] Patent Number: 5,613,377

[45] Date of Patent: Mar. 25, 1997

[54] METHOD AND EQUIPMENT FOR RESTRAINING THE END PORTIONS OF CUT THREAD PROTRUDING FROM COLLARS FOR KNIT WEAR ARTICLES AND THE LIKE

[75] Inventors: Mario Marchesi; Riccardo Marchesi, both of Florence, Italy

[73] Assignee: A.R.M.I. Assistenza Ricambi Macchine Industriali S.r.l., Florence, Italy

[21] Appl. No.: 564,391

[22] Filed: Nov. 29, 1995

[30] Foreign Application Priority Data

Dec. 2, 1994 [IT] Italy ..... FI94A0216

[51] Int. Cl.[6] ..... D04B 15/00

[52] U.S. Cl. ..... 66/145 S; 139/434

[58] Field of Search ..... 66/125 A, 125 R, 66/127, 145 B; 139/434

[56] References Cited

U.S. PATENT DOCUMENTS 4,957,144 9/1990 Watanabe et al. ..... 139/434

5,316,050 5/1994 Bertch ..... 139/434

*Primary Examiner*—John J. Calvert

*Attorney, Agent, or Firm*—Browdy and Neimark

[57] ABSTRACT

A method and relative equipment, applicable to a knitting machine for the production of collars and similar articles, for restraining, during knitting, the terminal portions of cut thread (12, 13) protruding from the edge (5) of said collars by inserting them inside the courses of stitches which compose them. The means for inserting (16) said thread ends (12, 13) between two successive courses of stitches (2,3 and 3,4) while knitting, comprise at least one nozzle (27, 37) producing a fluid current(22, 32). One of the nozzles (37) may be able to rotate from a first direction (A) of catching the end portion of thread to a second direction (B) aligned with the courses of stitches during the knitting process. Means for inserting can also comprise a first nozzle (27) producing a first jet of fluid (22) for catching the thread end and a second nozzle (37) producing a second jet of fluid (32) for inserting it between two courses of stitches. The restraint of the end portions of thread (12, 13) is carried out automatically while knitting, with considerable advantage compared to manual restraining as well as mechanical inserting, thanks to the precision of fluid jets (22, 32) which are preferably of air or water.

13 Claims, 2 Drawing Sheets

METHOD AND EQUIPMENT FOR RESTRAINING THE END PORTIONS OF CUT THREAD PROTRUDING FROM COLLARS FOR KNIT WEAR ARTICLES AND THE LIKE

DESCRIPTION

1. Field of the Invention

The present invention relates to the field of textiles and, more precisely, to a method for restraining the terminal portions of cut thread protruding from collars for knit-wear and similar articles by inserting them inside the stitches which compose the articles while knitting. The invention, furthermore, relates to equipment for carrying out said method.

2. Description of the Prior Art

Collars are usually knitted separately to be sewn onto knit-wear articles at a later time. Normally, long strips of collars are produced attached in turn to one another along one common side and gathered on rolls. Collars are linked to one another by means of temporary threading which can be removed by pulling, for example, the connecting thread. Each collar can be of a solid color or comprise one or more bands of color, just as it can have multicolor designs on a background color.

The strips of linked collars are produced on flat knitting machines and each collar produced by the machine is attached to those preceding and following it not only by the above-mentioned connecting thread but also by the thread composing the collar itself which continues to the following collar forming a loop at the same point as the connecting side.

Once dying has been completed, the collars are separated from one another by cutting and pulling away the connecting thread and cutting the loop of the above-mentioned thread. After separating the collars, it is necessary to insert the ends of the cut thread inside the stitches of thread that form the collar, so that they do not protrude from the collar disturbing its aesthetic value. The insertion of the ends is carried out by inserting a special needle inside a portion of knitted collar until reaching the edge corresponding to the point from which the end portion of the thread extends. The end portion is then pulled inside the collar where it is restrained and hidden by the course of stitches forming the knit collar. The insertion is generally performed manually and requires a certain ability to assure that, with use, the thread does not come out of the collar.

For collars of a solid color, the operation is carried out only once, since, of the two end portions of thread which protrude from each collar, one will be directly inserted into the stitches, with which the collar will be attached to the knit article.

On the other hand, when collars comprise more than one color, two additional ends of thread protrude from the edge for every color change. For example, for a collar having a band of color different from the background color, in the finishing steps, it will be necessary to insert five thread ends (four for the two changes in color and one at the end), whereas for a collar with two bands of color different from the background, it will be necessary to insert nine thread ends (eight for four color changes and one at the end).

Therefore, the desirability, of automatically inserting the thread ends during the knitting process rather than inserting them manually in the finishing steps with the requirement of considerable labor is strongly felt.

There is a known machine for the production of collars in which the operation of inserting the ends of protruding thread is performed during knitting by a mechanical needle. As the ends are produced, the needle inserts them between two successive courses of stitches, awaiting the moment of knitting to be withdrawn so that each end portion is restrained inside. However, in order to prevent the needle, when it withdraws, from dragging the thread end with it, pulling it newly out of the knitting, dollars produced with this type of machine, have a tubular course of stitches which locally increases the thickness of the collar creating a poor aesthetic effect. Furthermore, this type of mechanism is even less appropriate when the knitting is very thin, since, in this case, the above-mentioned effect would be accentuated.

SUMMARY OF THE INVENTION

The object of the present invention is, therefore, to provide a method for inserting the ends of thread protruding from the edges of collars and similar knit articles into the article, during knitting, which does not incur any of the above-mentioned inconveniences and which, at the same time, is simple to carry out.

A further object of the present invention is to provide an apparatus which carries out said method.

These and other objects are accomplished by the present invention, whose method is characterized by the fact that the step of catching and inserting the end of the thread occurs by means of at least one current of fluid.

Preferably, two coplanar and orthogonally directed jets of a fluid, such as air or water, are provided for. The first jet captures the portion of thread at the time of the cut and orients it in a direction which is not parallel to the knitting, whereas the second jet, which intervenes after the first, aligns the portion of thread with two consecutive courses of stitches, so that they include it at the time of knitting the preceding and following ones.

Advantageously, one of the two jets of fluid accompanies the thread end by means of a rotation in said plane, from a position aligned with the first jet to a position aligned with the two courses of stitches during knitting.

The equipment which carries out said method is characterized by the fact that it comprises at least one nozzle connected with means for emission of fluid under pressure. Preferably, it comprises two nozzles communicating with a network of compressed air through command electro-valves.

According to one advantageous solution, the second nozzle is mounted on a rotatable support and can be oriented between two positions in which the jet coming out of it is aligned respectively with the jet of the first nozzle and with the two courses of stitches being knitted. The first nozzle is positioned in proximity to the edge of the knit article in order to catch the protruding ends of thread immediately after they have been cut.

BRIEF DESCRIPTION OF THE DRAWINGS

Further characteristics and advantages of the method and equipment according to the present invention will become more apparent in the description which follows of one of its embodiments, given as an example and not limitative, with reference to the attached drawings in which.

DESCRIPTION OF THE PREFERRED EMBODIMENTS

Figure 1:
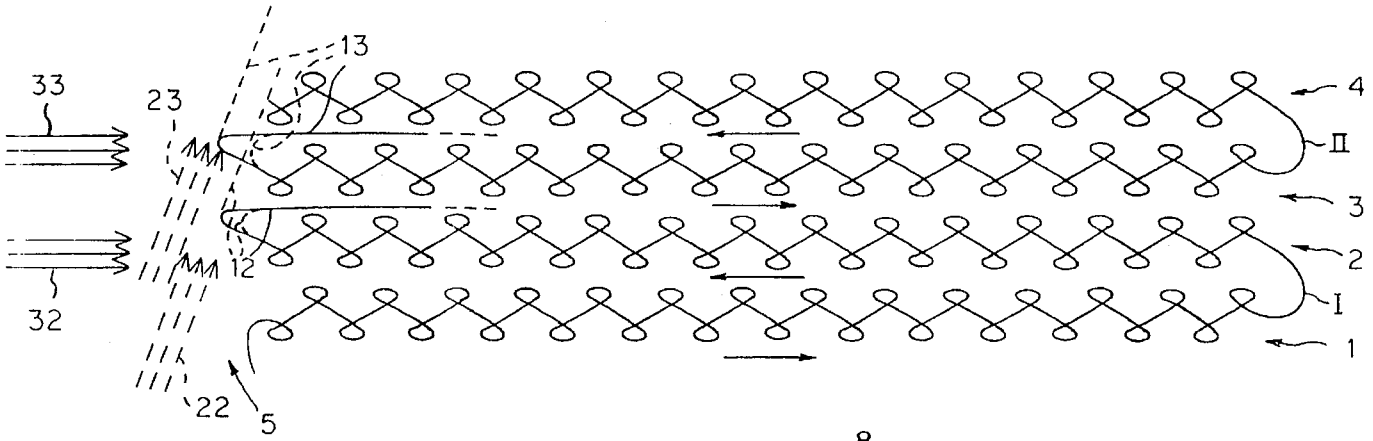
FIG. 1 is a schematic view of the inserting steps of a thread protruding from the edge of a collar between consecutive courses of stitches by means of air jets according to the invention.

In cases in which, during knitting, a color change or separation of two adjacent collars must be carried out, the situation illustrated schematically in FIG. 1 may occur, with a first and second course of stitches indicated respectively with 1 and 2, and knitted in opposite directions, and a third and fourth course of stitches indicated with 3 and 4 also knitted in opposite directions. The consecutive courses of stitches, here illustrated separate from one another for the sake of clarity, are obviously, in reality, knitted together.

In the passage from course 2 to course 3, when it is necessary to pass from thread I to thread II, for example of a different color, the end portions 12 and 13 of thread protruding from the edge of the knit article remain free. In a similar manner (not illustrated), course 2 could belong to one collar whereas course 3 could belong to another, and, in this case, end portions 12 and 13 would be composed of the same thread.

Thread ends 12 and 13 protruding from edge 5 must be inserted respectively between courses of stitches 2 and 3 and between courses of stitches 3 and 4, during knitting.

More precisely, with reference to FIG. 1, course 1 is knitted from left to right and, then, with the same thread, course 2 is knitted from right to left. When there is a change of thread, once edge 5 has been newly reached, the first thread I is held by pincers (not shown in this figure) and cut so that end 12 of thread I remains free and protruding from edge 5 itself.

According to the invention, thread end 12 is caught by a jet of air 22 and directed parallel to it. Subsequently, a jet of air 32 intervenes and directs end 12 parallel to course 2 until making it completely enter with respect to edge 5. At this point, the knitting of course 3 is begun by means of a thread II of a different color, the end 13 of which is free and protruding from edge 5. The knitting of course 3, from left to right, causes the insertion of end 12 between course 2 and course 3. During the knitting of course 3, a jet of air 23 catches end 13 and orients it in the direction of the current, to allow a subsequent jet of air 33 to capture it, in turn, and align it with course 3 so that the knitting of course 4 with the same thread II causes the insertion of end 13 between course 3 and course 4.

With the method according to the present invention, therefore, the insertion of thread ends 12 and 13 is carried out automatically while knitting, with considerable advantage with respect to manual inserting and, in any case, with advantage with respect to the mechanical insertion described above since it is not necessary to introduce a needle or other equivalent means between two successive courses of stitches during knitting, which would cause a modification of the form of the knit article as described above.

Figure 2:
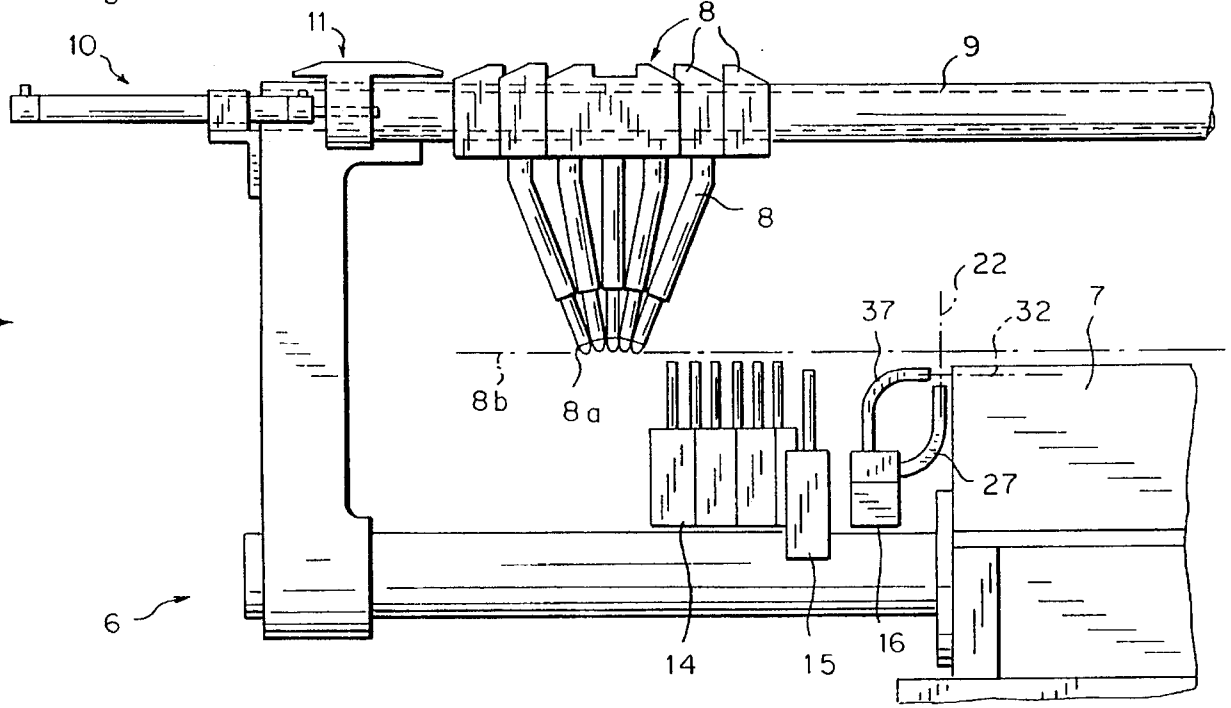
FIG. 2 is a side elevational view of a machine for collars provided with equipment according to an embodiment of the invention.
Figure 3:
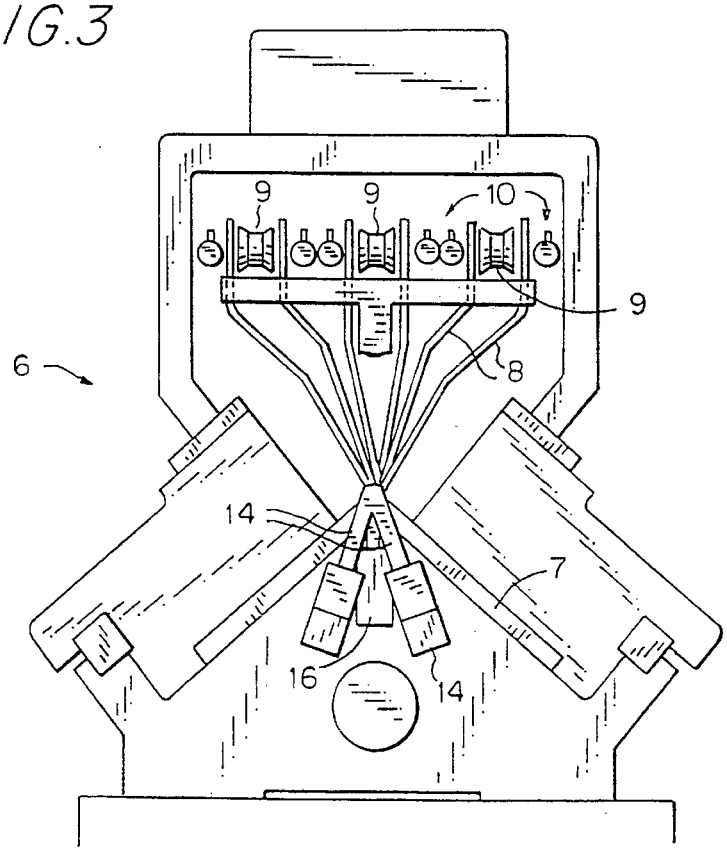
FIG. 3 is a front view of the machine in FIG. 2.

With reference to FIGS. 2 and 3, a textile machine 6 of a known type for the production of knit collars and similar articles comprises a supporting surface 7, with an ascending plane and a descending plane, on which, during knitting, the collars (not shown for the sake of simplicity) slide. It also comprises a plurality of thread guides 8 which slide on bars 9 and whose travel is limited by a block 11 operated by pneumatic means 10. Each thread guide 8, by means of its end 8*a* which moves on a rectilinear travel 8*b*, carries a thread of different color or quality and each free thread end is held by pincers 14. Passing from one type of thread to a subsequent one, thread guide 8 with the thread to be substituted moves backward and one of pincers 14 takes hold of it. Subsequently, a shear 15 cuts it leaving one of the above-described thread ends, indicated in FIG. 1 with 12 and 13, free.

According to this embodiment of the invention, equipment for inserting and restraining thread ends applicable to a machine for collars comprises a pneumatic insertion 16 of the thread, provided with a first nozzle 27 and a second nozzle 37 which align said portion of thread with two successive courses of stitches during knitting, assuring its insertion between them.

More precisely, a jet of air 22 coming out of nozzle 27 catches an end portion of thread (not shown) aligning it with itself, waiting for a second jet of air 32 coming from nozzle 37 to align it with the course of stitches while knitting in order to allow for its insertion.

The inserting equipment according to the invention is, therefore, extremely simple and makes it possible to avoid the inconveniences of existing systems, in particular those of equipment according to known techniques comprising mechanical means for the insertion of loose thread ends. In fact, the catching of the thread by means of air jets is extremely precise and safe, not allowing errors and making it possible to carry out the inserting step also when the knitting is very fine and tight.

Figure 4A:
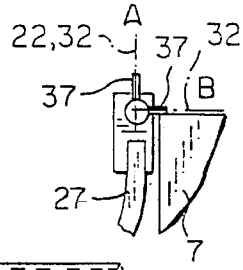
FIG. 4 is a side elevational view of a different embodiment of the machine of FIG. 2.
Figure 4:
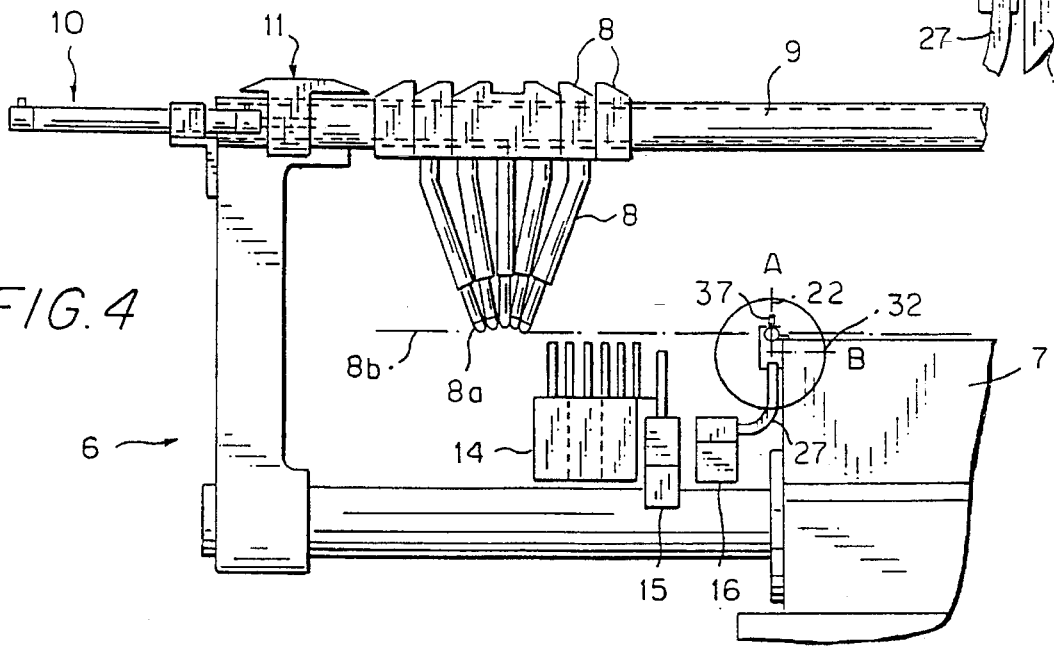

With reference to FIG. 4, according to another embodiment of the invention, second nozzle 37 is mobile and can rotate from a position A to a position B correspondingly directing the air jet 32 coming from it. In this way, the inserting step of the thread end occurs in the following manner. The first jet of air 22 coming out of nozzle 27 catches the end portion of thread aligning it with itself as well as with the second jet of air 32 coming from nozzle 37 in position A. Then second jet of air 37 turns from position A to position B carrying with it the end portions of thread to align it with the course of stitches while knitting. In this way, there is no discontinuity in the passage from the hold of air jet 22 to the hold of air jet 32 and a greater precision of insertion of the thread is obtained.

The possibility of orienting air jet 32 coming from rotatable nozzle 37 can in some cases make the presence of air jet 22 optional. In fact, air jet 32 can catch and insert the end portion of thread by itself thanks to its ability to orient itself.

Although reference has been made to jets of air for catching and inserting the end portions of thread, the successful use of jets of water has not been excluded, especially when the thread is particularly thick and heavy, in which case it would be necessary to use jets of air too powerful to control.

Furthermore, although reference has been made to fluid currents accomplished by means of air or liquid jets, clearly it is equally possible to accomplish the object of catching and orienting the end portions of thread by means of air currents created by suction.

Finally, as an alternative to air currents and water jets, an oriented electric field could also be used to achieve the above objects, as long as the thread used has high dielectric characteristics.

We claim:

1. A method for restraining the end portions of cut threads protruding from the edges of collars for knit-wear or similar articles while knitting, said articles being formed by a succession of courses of stitches, comprising the steps of:

cutting said thread after having knitted a chosen course of stitches with the release of a thread end protruding from said edge and contemporaneous gripping of said thread end, releasing free said thread end and contemporaneously catching said thread end by means of a first fluid current acting in a catching direction, and inserting said thread end between said chosen course of stitches and the subsequent course of stitches by means of a second fluid current acting in an inserting direction coplanar and inclined at an angle with respect to said catching direction, said inserting direction being aligned with said chosen course of stitches.

2. The method according to claim 1 wherein said second fluid current is obtained by rotating said first fluid current from said catching direction to said inserting direction.

3. The method according to claim 1 wherein said first fluid current and said second fluid current are fluid jets produced from positive pressure.

4. The method according to claim 1, wherein said fluid is air.

5. The method according to claim 1, wherein said fluid is liquid.

6. The method according to claim 1, wherein said angle is substantially a right angle.

7. The method according to claim 1, wherein said step of inserting follows said step of releasing and said second current supersedes said first current, such that the first current and the second current are sequential.

8. Equipment applicable to a textile machine for the production of knitted collars and similar articles, said articles being formed by a succession of courses of stitches, said articles having an edge transversal to said course of stitches from which thread ends protrude while knitting, comprising shear means for cutting said thread ends protruding from said edge of said articles while knitting;

pincer means adjacent to said shear means for gripping and releasing said thread ends after being cut;

means for inserting said thread ends when released by said pincer means between two chosen successive courses of stitches, said means for inserting including means for producing a first fluid current acting in a catching direction and a second fluid current acting in an inserting direction coplanar and inclined with respect to said catching direction, said inserting direction being aligned with said chosen courses of stitches.

9. The equipment according to claim 8 wherein said means for inserting said thread ends comprise a first nozzle producing a first fluid current acting in said catching direction and a second nozzle producing a second fluid current acting in said inserting direction.

10. The equipment according to claim 8 wherein said means for inserting said thread ends includes a nozzle able to rotate from said catching direction to said inserting direction, said fluid current accompanying said thread ends from a catching position corresponding to said catching direction to an inserting position corresponding to said inserting direction.

11. The equipment according to claim 8, wherein said fluid current is a fluid jet produced from positive pressure.

12. The equipment according to claim 8, wherein said fluid is air.

13. The equipment according to claim 8, wherein said fluid is liquid.

* * * * *